US005918917A

United States Patent [19]

Elton et al.

[11] Patent Number: 5,918,917

[45] Date of Patent: Jul. 6, 1999

[54] VEHICLE DOOR LATCH WITH CINCHING MECHANISM

[75] Inventors: Robert Douglas Elton, Ann Arbor; Lloyd Walker Rogers, Jr., Shelby Township, Macomb County, both of Mich.

[73] Assignee: General Motors Corporation, Detroit, Mich.

[21] Appl. No.: 08/898,324

[22] Filed: Jul. 22, 1997

[51] Int. Cl.[6] ..... E05C 3/06

[52] U.S. Cl. ..... 292/201; 292/DIG. 23; 292/DIG. 46

[58] Field of Search ..... 70/279; 292/DIG. 65, 292/201, 216, DIG. 23–DIG. 25, DIG. 46

[56] References Cited

U.S. PATENT DOCUMENTS

| | | | |
|---|---|---|---|
| 4,875,723 | 10/1989 | Compeau et al. | 292/201 |
| 5,288,115 | 2/1994 | Inoue et al. | 292/201 |
| 5,537,848 | 7/1996 | Grzanka et al. | 70/279 |
| 5,564,761 | 10/1996 | Mizuki et al. | 292/201 |
| 5,639,130 | 6/1997 | Rogers, Jr. et al. | 292/216 |
| 5,715,713 | 2/1998 | Aubry et al. | 70/277 |

*Primary Examiner*—Suzanne Dino Barrett
*Assistant Examiner*—John B. Walsh
*Attorney, Agent, or Firm*—Charles E. Leahy; Kathryn A. Marra

[57] ABSTRACT

A vehicle door latch has a rotatable fork bolt that is latched by a detent in primary or an intermediate secondary latch position. The detent is operated via an intermittent lever that is operated by a transfer lever that is actuated by inside and outside door handles via suitable mechanical linkage. The door latch includes a locking lever that disables the door handles from operating the intermittent lever when it is in the locked position. The door latch also includes a cinching mechanism that automatically engages the fork bolt in the primary latch position when the intermediate secondary latch position is reached. The cinching mechanism shifts out of the way responsive to an unlatching operation to provide a fail-safe feature.

7 Claims, 5 Drawing Sheets

VEHICLE DOOR LATCH WITH CINCHING MECHANISM

TECHNICAL FIELD

This invention relates generally to vehicle door latches and more particularly to vehicle door latches that have a primary and an intermediate latching position.

BACKGROUND OF THE INVENTION

U.S. Pat. No. 5,277,461 issued to Thomas A. Dzurko et al Jan. 11, 1994 discloses a vehicle door latch that has a rotatable fork bolt that is engaged and rotated by a striker in the door jamb of the vehicle when the vehicle door is slammed shut. The fork bolt has two latch shoulders that are engaged by a detent to retain the fork bolt in either a primary or an intermediate secondary latch position depending upon which of the two latch shoulders is engaged by the detent. The detent engages the primary latch shoulder and latches the fork bolt in the primary latch position when the vehicle door is slammed shut with sufficient force. This is the preferred condition. The fork bolt also has an intermediate secondary latch shoulder that is initially engaged by the detent during the latching operation. The secondary lock shoulder latches the fork bolt in an intermediate secondary latched position and holds the vehicle shut in the event that the closure force is too light to engage the primary latch shoulder is not as great as in the preferred primary latch position. The secondary latch position is easily recognized and rectified by opening the vehicle door and reclosing the vehicle door with a greater force.

SUMMARY OF THE INVENTION

The object of this invention is to provide a vehicle door latch having a cinching mechanism that automatically engages the vehicle door latch in a primary latched position when the fork bolt has been moved a predetermined distance.

A feature of the invention is that the vehicle door latch has a cinching mechanism that automatically drives a fork bolt to a primary latched position responsive to movement of the fork bolt.

Another feature of the invention is that the door latch has a cinching mechanism that is driven by an electric motor that is controlled by the fork bolt.

Still another feature of the invention is that the vehicle door latch has a cinching mechanism that shifts out of the way to avoid interference with an intentional unlatching operation.

Still another feature of the invention is that the vehicle door latch has a cinching mechanism that is associated with the latching mechanism so that the cinching mechanism is automatically shifted out of the way when the vehicle door latch is unlatched in a conventional manner.

Yet another feature of the invention is that the vehicle door latch has a cinching mechanism that includes a shifting mechanism that automatically uncouples the cinching mechanism during a conventional unlatching operation.

Still yet another feature of the invention is that the vehicle door latch has a cinching mechanism that is driven by a bidirectional motor that resets the cinching mechanism at the end of the cinching stroke.

These and other objects, features and advantages of the invention will become more apparent from the following description of a preferred embodiment taken in conjunction with the accompanying drawing.

DETAILED DESCRIPTION OF THE PREFERRED EMBODIMENT

Figure 1:
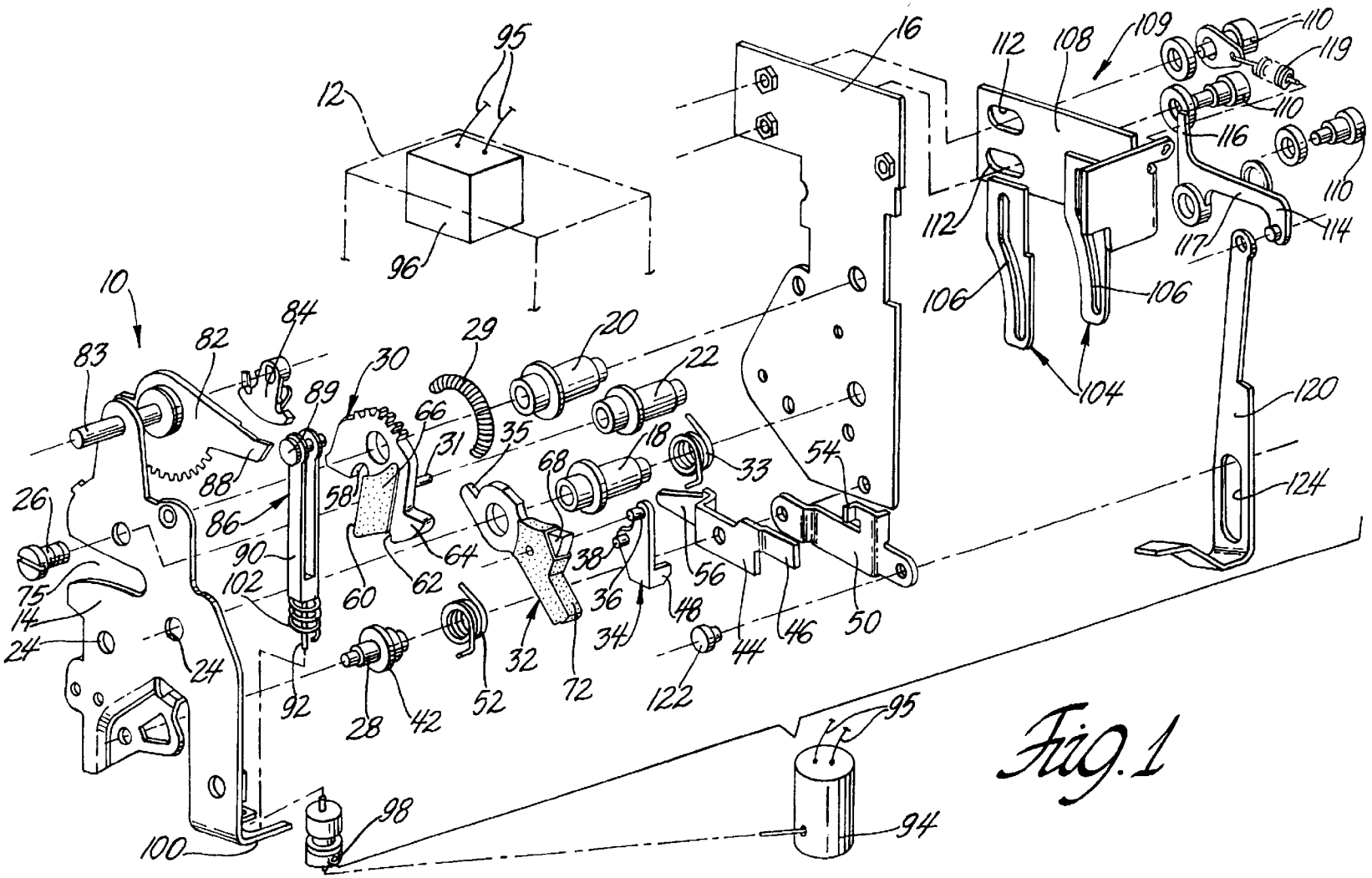
FIG. 1 is an exploded perspective partially schematic view of a vehicle door latch according to the present invention.

Referring now to the drawing and more particularly to the exploded perspective view of FIG. 1, the vehicle door latch 10 is the same basic arrangement as the vehicle door latches that are disclosed in U.S. Pat. No. 5,277,461 granted to Thomas A. Dzurko et al Jan. 11, 1994 for a vehicle door latch, U.S. Pat. No. 4,756,563 granted to Stephen L. Garwood and Jeffrey Konchan Jul. 12, 1988 for a vehicle door latch and U.S. Pat. No. 5,054,827 granted to Jeffrey L. Konchan and Jiri Paulik Oct. 8, 1991 for a vehicle door latch, all of which are hereby incorporated in this patent specification by reference.

The vehicle door latch 10 has a multipiece enclosure that comprises plastic housing 12, metal face plate 14 and metal back plate 16. The plastic housing 12 and the metal back plate 16 are held together by three flanged, internally threaded bushings 18, 20 and 22 that are inserted into three holes in the plastic housing 12, then through three aligned holes in the back plate 16 and then flanged over the back plate. The metal face plate 14 has three bolt holes 24 that are aligned with the bushings 18, 20 and 22 when the metal face plate is attached to the plastic housing 12 by a screw 26. The metal face plate 14 and the metal back plate 16 have lower portions below the plastic housing 12 that are held together by a flanged stud 28 that has projecting pins at each end that are inserted in holes in the plates and peened or headed over.

The Latching Mechanism

Figure 2:
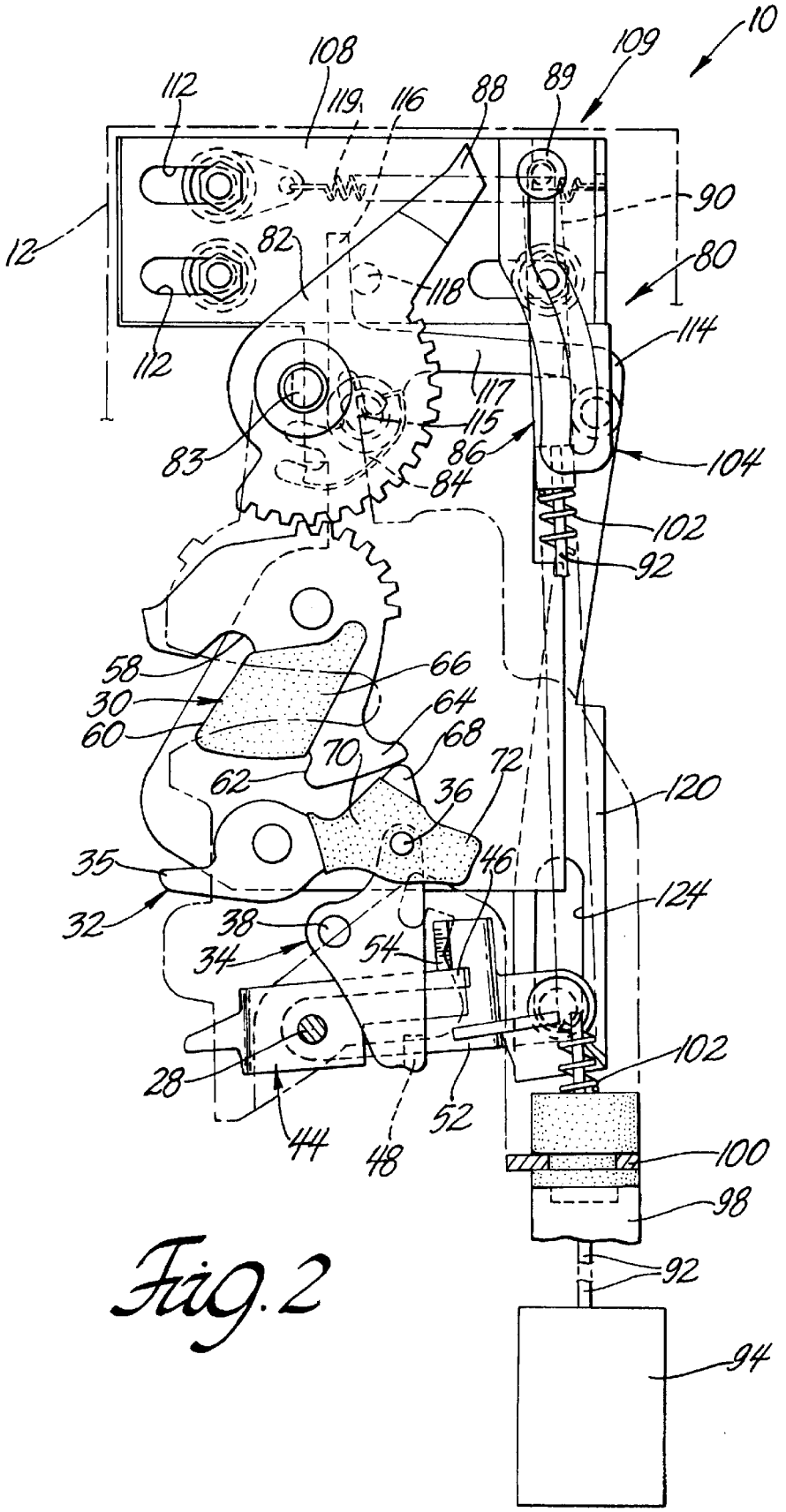
FIG. 2 is a fragmentary front elevational view of the vehicle door latch of FIG. 1 showing the door latch in an unlatched and unlocked condition.
Figure 3:
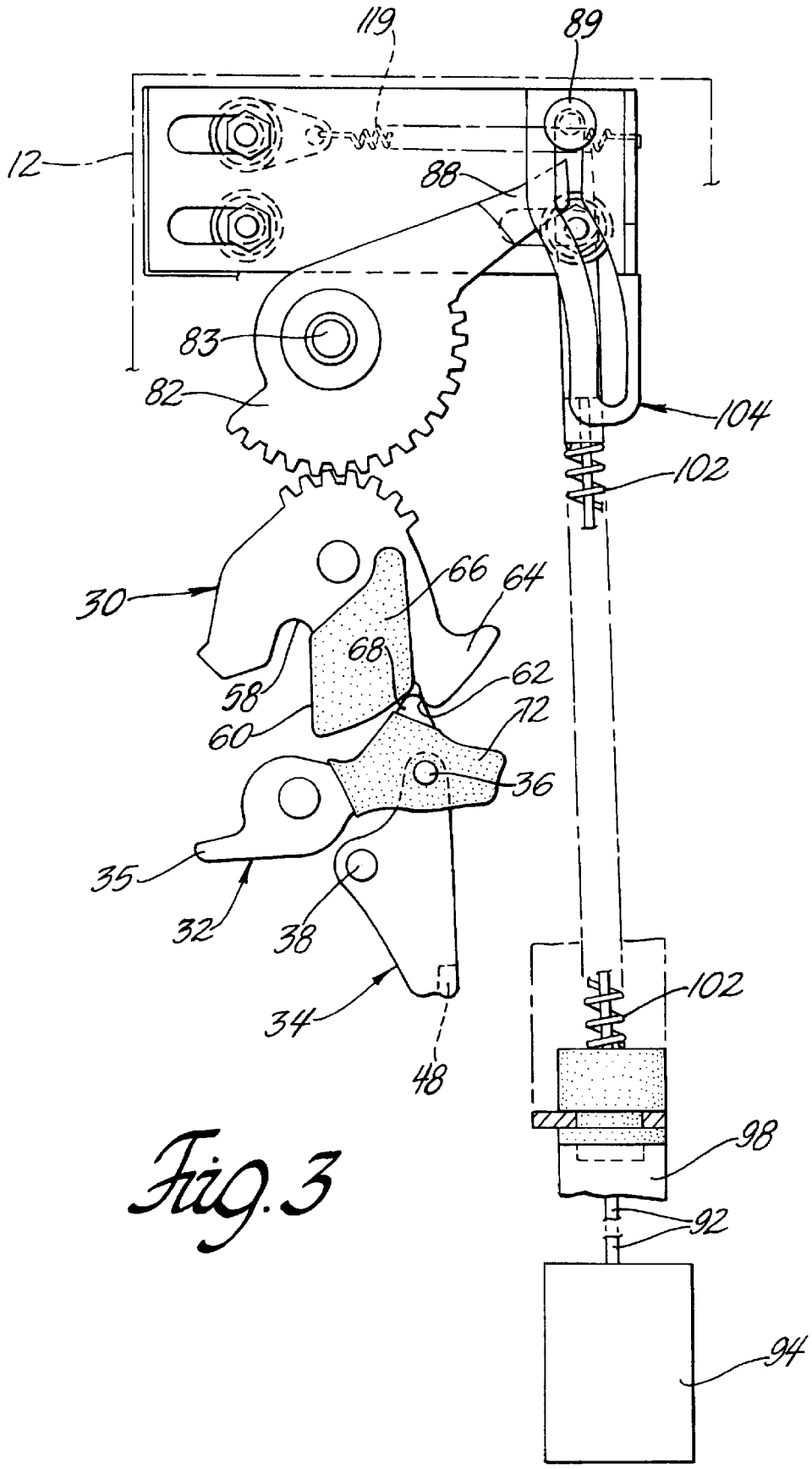
FIG. 3 is a fragmentary front elevational view showing the vehicle door latch in an intermediate secondary latched and unlocked condition.
Figure 4:
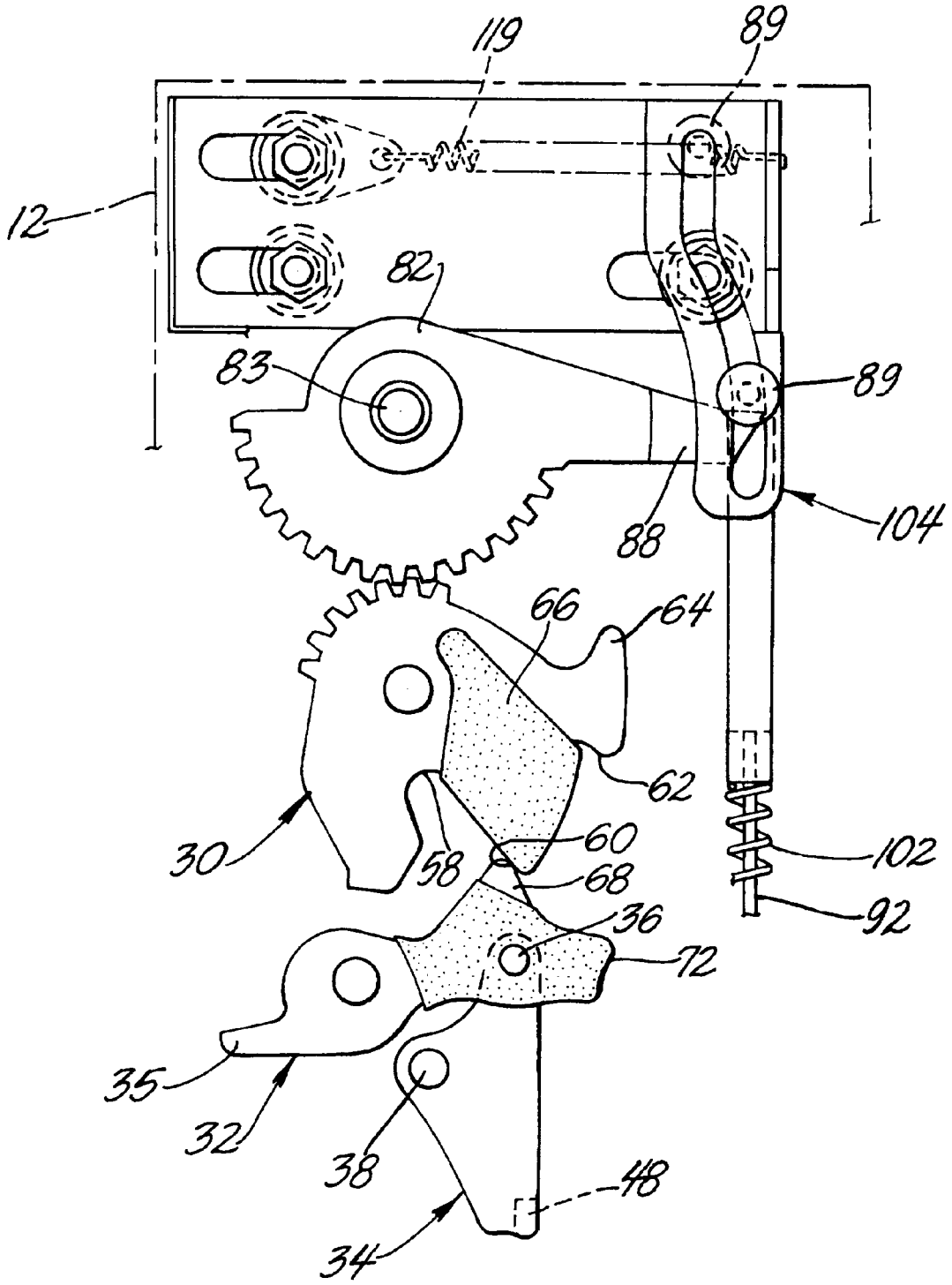
FIG. 4 is a fragmentary front elevational view showing the vehicle door latch in the final stage of being automatically driven from the secondary latched and unlocked condition to a primary latched and unlocked condition.

The latching mechanism of the vehicle door latch 10 comprises a fork bolt 30 and a cooperating detent 32 that are pivotally mounted on bushings 20 and 18 respectively and located in a chamber of the plastic housing 12 behind the metal face plate 14. The fork bolt 30 is biased clockwise by a coil spring 29. Coil spring 29 is disposed in a curved slot in the plastic housing 12 behind the fork bolt 30 and it engages a depending pin 31 of the fork bolt 30 at one end. Detent 32 is biased counterclockwise into engagement with the fork bolt 30 by a coil spring 33 that surrounds the bushing 18 and that has one end engaging an ear 35 of the detent 32. Detent 32 engages the fork bolt 30 in its unlatched position as shown in FIG. 2 and engages and holds the fork bolt lever 30 in intermediate secondary and primary latched positions against the bias of spring 29 as shown in FIGS. 3 and 4, respectfully.

The latching mechanism further comprises an intermittent lever 34 for operating the detent 32. The intermittent lever 34 is located in the chamber of the plastic housing 12 behind detent 32. It has two integral pivot pins 36 and 38. Pivot pin 36 is journalled in a hole in detent 32 so that the detent 32 rotates clockwise from the position shown in FIGS. 3 or 4 (and out of latched engagement with the fork bolt 30) to the unlatched position shown in FIG. 2 when the intermittent lever 34 is pulled down. The pivot pin 38 is disposed in a slot of a locking lever (not shown) that pivots the intermittent lever 34 counterclockwise about pivot pin 36 from the unlock position shown in FIGS. 2, 3, 4 and 5 to a lock position (not shown). The locking lever is journalled on the stud 28 between the flange 42 and the faceplate 14. The operation of the locking lever and the locking mechanism does not form a part of this invention and hence the elements of the locking mechanism have been omitted for clarity. Briefly the lock lever is rotated clockwise by suitable linkages that are controlled inside and outside the vehicle electrically or mechanically to lock the door latch 10 or counterclockwise to unlock the door latch. Clockwise rotation pivots intermittent lever 34 counterclockwise about pivot pin 36 to a position where it is uncoupled from and out of the path of travel of transfer lever 44 described below. A complete description of the locking lever and locking mechanism is given in the three patents cited above that have been incorporated in this patent specification by reference.

The latching mechanism further comprises a transfer lever 44 that is journalled on a reduced diameter portion of the stud 28 spaced rearwardly of the flange 42. The transfer lever 44 has an ear 46 at one end that is engageable with an integral, rearwardly projecting tab 48 of the intermittent lever 34 so that the intermittent lever 34 is pulled down when the transfer lever 44 is rotated clockwise as viewed in FIGS. 1 and 2.

The latching mechanism further comprises an outside operating lever 50 and a coil return spring 52. The outside operating lever 50 is also journalled on the reduced diameter portion of the stud 28 behind the transfer lever 44. It has a bent tab 54 that engages the ear 46 of the transfer lever 44 so that the outside operating lever 50 rotates the transfer lever 44 clockwise when it is rotated clockwise on stud 28. The outside operating lever 50 is connected by suitable linkage for rotation by an outside door handle (not shown).

The coil return spring 52 is disposed around the stud 28 and located between the flange 42 and the transfer lever 44. One end of the coil spring 52 engages the bottom of transfer lever 44 and the other end engages the bottom of the plastic housing 12 above the transfer lever 44 so that the transfer lever 44 and outside operating lever 50 are biased counterclockwise to a rest position where tab 54 engages the bottom of the plastic housing 12.

The latching mechanism further comprises an inside operating lever (not shown) that is pivotally mounted on a flange of the metal faceplate 14. The inside operating lever has a tab that engages a second ear 56 of the transfer lever 44 so that the inside operating lever also rotates the transfer lever 44 clockwise when it is rotated counterclockwise. The inside operating lever is connected by suitable linkage for rotation by an inside door handle (also not shown). The inside operating lever also has been omitted for clarity and is explained in detail in the three patents cited above that have been incorporated in this patent specification by reference.

Fork bolt 30 has a conventional slot or throat 58 for receiving and retaining a strike member, such as that shown in the three patents cited above, that is attached to the vehicle door pillar to latch the vehicle door in the closed position (not shown). Fork bolt 30 also includes a primary latch shoulder 60, an intermediate secondary latch shoulder 62 and a radially projecting foot 64. Fork bolt 30 preferably has a plastic coating 66 that covers a surface of the slot 58 that is engaged by the striker for energy absorption and quiet operation when the vehicle door is slammed shut.

Detent 32 has a sector shaped catch 68 that engages the radially projecting foot 64 when the fork bolt 30 is in the unlatched position as shown in FIG. 2. The sector shaped catch 68 positively engages the primary and intermediate secondary latch shoulders 60 and 62 to hold the fork bolt 30 in either the primary or the intermediate secondary latched positions shown in FIGS. 4 and 3 respectively. Detent 32 also preferably includes a plastic coating 70 that has an integral bumper 72. The bumper 72 engages the bushing 22 to stop counterclockwise pivoting of the detent lever 32 under the bias of spring 52. This bumper 72 also absorbs energy and quiets operation when the door is slammed shut.

The conventional latching mechanism described above operates as follows. When the door latch 10 is in an unlatched and unlocked condition as shown in FIG. 2, fork bolt 30 is poised to receive a conventional strike member (not shown) that projects into aligned fish mouth slots 74 and 75 of the plastic housing 12 and the metal face plate 14 when the door is shut. The entering strike member engages the plastic coating 66 at the back of the throat 58 and rotates fork bolt 30 counterclockwise against the bias of spring 29 until fork bolt 30 is rotated to the primary latch position shown in FIG. 4 where fork bolt 30 captures the striker in the throat 58. Fork bolt 30 is held in the primary latch position by catch 68 of detent 32 engaging the primary latch shoulder 60 of fork bolt 30.

Catch 68 rides along the periphery of the fork bolt 30 under the bias of spring 52 as fork bolt 30 rotates counterclockwise from the unlatched position shown in FIG. 2 to the primary latch position shown in FIG. 4. During this travel, catch 68 rides under the foot 64 into engagement with the intermediate secondary latch shoulder 62 as shown in FIG. 3 and then under the coated portion into engagement with the primary latch shoulder 60. It is to be noted that the engagement of catch 68 with the intermediate secondary latching shoulder 62 is sufficient to hold the vehicle door closed in the event that the vehicle door is not shut with sufficient force so that catch 68 engages primary latch shoulder 60.

The vehicle door latch 10 is not locked so that the vehicle door can be opened simply by operating either an inside or outside door handle or the like to rotate the transfer lever 44 clockwise and the ear 46 down as viewed in FIG. 2. Ear 46 engages projection 48 of intermittent lever 34 and pulls the intermittent lever 34 down from the primary latch position shown in FIG. 4 to the unlatched position shown in FIG. 2. As the intermittent lever 34 is pulled down, it rotates detent 32 clockwise against the bias of spring 52 from the primary latch position shown in FIG. 4 to the unlatched position shown in FIG. 2. Fork bolt 30 is then free to rotate counterclockwise under the bias of spring 29 from the primary latch position shown in FIG. 4 to the unlatched position shown in FIG. 2 as the striker is pulled out of the aligned fishmouth slots 74 and 75 when the vehicle door is opened.

Briefly the lock mechanism which has been omitted for the sake of clarity operates as follows. The lock mechanism is actuated by rotating the locking lever (not shown) that is journalled on stud 28 between flange 42 and face plate 14 clockwise. Clockwise rotation of the locking lever rotates intermittent lever 34 counterclockwise about the pivot pin 36 that is journalled in the detent 32 due to the engagement of the second pivot pin 38 of the intermittent lever 34 in the slot of the locking lever. Intermittent lever 34 is thus rotated counterclockwise from the unlocked position shown in FIGS. 3 and 4 to a locked position where projection 48 is repositioned out from under ear 46 of transfer lever 44. Consequently when the door handles or the like are operated so as to rotate the transfer lever 44 clockwise to the unlatching position, the ear 46 simply bypasses the projection 48 without transferring any motion to the intermittent lever 34. Consequently intermittent lever 34 is not pulled down to rotate detent 32 to the unlatch position shown in FIG. 2. In other words the transfer lever 44 simply free wheels so that operation of the door handles or their equivalent is not effective.

The Cinching Mechanism

The cinching mechanism, indicated generally at 80 supplements the conventional operation of the latching mechanism by assuring that detent 32 engages the primary latch shoulder 60 of fork bolt 30 as shown in FIG. 4 when the fork bolt 30 has been moved toward a latch position by a predetermined amount.

Cinching mechanism 80 comprises a position lever 82 that is rotatably mounted in housing 12 above fork bolt 30 by an axle pin 83 that turns in journals in housing 12 and face plate 14. Position lever 82 is drivingly connected to fork bolt 30 by meshing integral sector gear portions so that position lever 82 moves between an unlatched position (FIG. 2) and a primary latch position (FIG. 4) via an intermediate secondary latch position (FIG. 3) corresponding to the respective positions of fork bolt 30. Axle pin 83 also carries a switch member 84. Position lever 82 and switch member 84 are both secured to axle pin 83 in a non-rotatable manner so that position lever 82 and switch member 84 rotate in unison.

Cinching mechanism further comprises a drive member 86 that engages arm 88 of position lever 82 and drives fork bolt 30 to the primary lock position via position lever 82 as explained below. Drive member 86 comprises a drive pin 89 that is attached to an open end of a clevis 90. Arm 88 projects into the slot of clevis 90 below drive pin 89 when drive member 86 drives position lever 82.

The opposite closed end of clevis 90 is attached to the end of a pull cable 92 that is attached to a reversible electric motor that is shown schematically at 94 and that is connected electrically by wires 95 to a motor control switch 96 in housing 12. The sheath 98 for pull cable 92 has one end attached to a flange 100 of face plate 14 by a suitable connector. The upper end of pull cable 92 is surrounded by a coil shaped compression spring 102 that engages the bottom of clevis 90 and the top of flange 100 to push clevis 90 upwardly with respect to housing 12 and face plate 14.

Cinching mechanism 80 further comprises a cam arrangement that includes two spaced cam plates 104 each having a cam slot 106 aligned with the other. The spaced cam plates 104 straddle clevis 90 and the drive pin 89 at the end of clevis 90 has end portions disposed in the aligned cam slots 106 so that drive pin 89 is the follower member of the cam arrangement. Cam plates 104 are attached to a support plate 108 that is attached to back plate 16 so as to form part of a shift or slide mechanism 109 for the cinching mechanism 80.

Support plate 108 is attached to back plate 16 by three slide bolts 110 that pass through slots 112 of the support plate 108 so that the support plate 108 shifts or slides laterally with respect to the housing 12 and back plate 16.

Shift mechanism 109 further comprises a bell crank 114 that is pivotally attached to the back plate 16 by pin 115, located below support plate 108. Bell crank 114 has a vertical arm 116 and a horizontal arm 117. Vertical arm 116 engages a pin 118 that projects from the back of support plate 108 so that support plate 108 shifts laterally to the right against the bias of return spring 119 when bell crank 114 is rotated clockwise as viewed in FIGS. 1 and 2. Bell crank 114 is rotated clockwise by pulling down horizontal arm 117 with a transfer link 120 that is connected to the end of arm 117 by a pivot pin and that is operatively associated with the latching mechanism. In this instance, the lower end of the transfer lever 120 is connected to the outside operating lever 50 by a slide bolt 122 that is fastened to operating lever 50 and that slides in a slot 124 in the lower end of the transfer link 120.

Operation of The Cinching Mechanism

The cinching mechanism operates as follows. When the vehicle door is open, the door latch 10 is in an unlatched position as shown in FIG. 2. As the vehicle door closes, the striker in the vehicle door jamb engages throat 58 of fork bolt 30 rotating fork bolt 30 counterclockwise which drives position lever 82 (and switch member 84 non-rotatably attached to axle pin 83) clockwise. When fork bolt 30 reaches the intermediate secondary latch position shown in FIG. 3, detent 32 engages secondary latch shoulder 62 and arm 88 of position lever 82 is located beneath drive pin 89 at the open end of clevis 90. Switch member 84 which rotates simultaneously with position lever 82 closes contacts in motor control switch 96 and energizes electric motor 94. Motor 94 then pulls pull cable 92 and drive member 86 down against the bias of return spring 102. Drive pin 89 moves downwardly in cam slots 106 pulling arm 88 downwardly. This rotates position lever 82 clockwise and drives fork bolt 30 counterclockwise until position lever 82 and fork bolt 30 reach the primary latch position shown in FIG. 4 where detent 32 engages primary latch shoulder 60. Switch member 84 which moves simultaneously with position lever 82 closes a limit switch in the motor control circuit at the end of the latching stroke reversing the electric motor 94 until drive pin 89 is returned to the starting position at the top of cam slots 106 by return spring 102 whereupon the electric motor 94 is deenergized. Suitable switches and motor control circuits are well known in the motor control art and need not be described in detail. Suffice it to state that drive pin 89 is returned to the starting position at the top of cam slots 106 to arm the cinching mechanism 80 and allow return of the position lever 82 to the unlatched position for the next cycle of operation.

The cinching mechanism 80 thus drives the fork 30 to the primary latch position and assures that the door latch 10 is in the primary latch position even if the vehicle door is not closed with sufficient force to achieve the primary latch position.

The door latch 10 is unlatched in a conventional manner by pulling the intermittent lever 34 down as described above.

Shift mechanism 109 assures that door latch 10 can be unlatched in a conventional manner in the event that drive pin 89 jams for one reason or another, such as electric power loss, in a position below the starting position shown in solid line in FIG. 2 and in phantom in FIG. 4.

Shift mechanism 109 responds to the conventional unlatching operation as follows. Door latch 10 is unlatched in a conventional manner by pulling intermittent lever 34 down by operating either an inside or outside door handle or the like to rotate transfer lever 44 clockwise and ear 46 down as viewed in FIG. 2. Ear 46 engages projection 48 of intermittent lever 34 and pulls intermittent lever down from the primary latch position shown in FIG. 4 to the unlatched position shown in FIG. 2. This rotates detent 32 clockwise against the bias of spring 52 releasing fork bolt 30 which then rotates counterclockwise under the bias of spring 29 as the striker (not shown) is pulled out of slots 74 and 75 when the vehicle door is opened.

Figure 5:
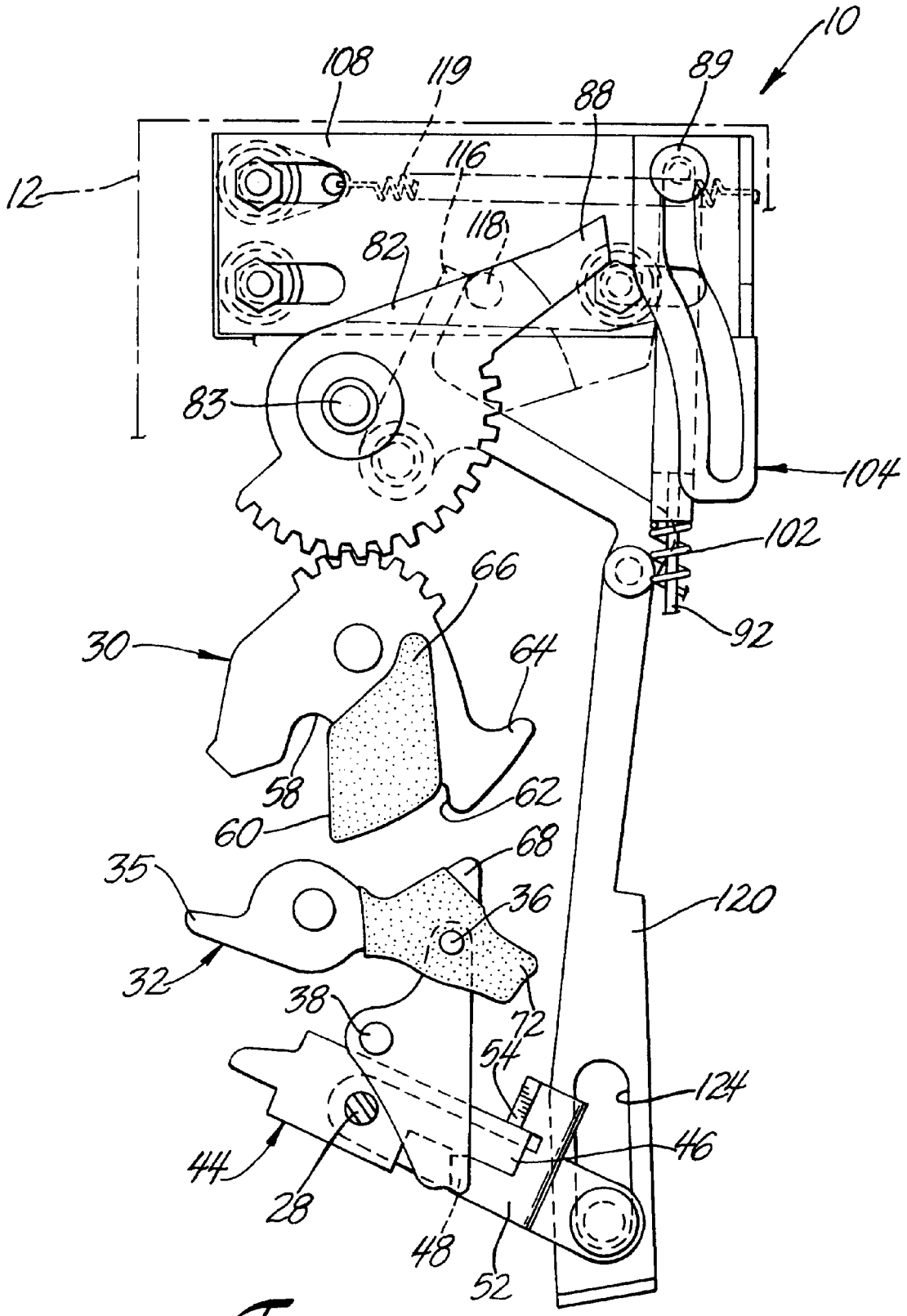
FIG. 5 is a fragmentary front elevational view showing the vehicle door latch in the process of being intentionally unlatched.

In this particular example, transfer lever 44 is rotated clockwise by outside operating lever 50 which also pulls transfer link 120 downwardly rotating bell crank 114 clockwise. As bell crank 114 rotates clockwise, arm 116 engages pin 118 and shifts support plate 108, cam plates 104 and drive pin 89 laterally to the right as shown in FIG. 5. Drive pin 89 is now out of the path of travel of arm 88 of position lever 82 irrespective of where drive pin is positioned in cam slots 106. Consequently shift mechanism 109 assures that door latch 10 can be unlatched in a conventional manner even if the cinching mechanism 80 jams for one reason or another.

After vehicle door latch 10 is unlatched and the door handle or the like is released, and the intermittent lever 34 and outside operating lever 50 are rotated counterclockwise by return spring 52 which releases transfer link 120. The shift mechanism 109 is then returned to the starting position shown in FIG. 2 by return spring 119.

In this particular example, the shift mechanism 109 is operated by the outside operating lever 50 which operates the transfer lever 44. However, the shift mechanism 109 can be tied into the latching mechanism of the door latch 10 in other ways. For instance the shift mechanism can be operated directly by the transfer lever 44 directly or in the case of an electrically operated door latch, the transfer link 120 can be driven by the linkage of the electric motor that unlatches the door latch 10. The important consideration is that the shift mechanism 109 is tied into the latching mechanism of the door latch 10 including linkages to the door handles or the like so that the shift mechanism 109 is automatically operated when the door is unlatched in a conventional manner so that a separate operator is not required to operate the shift mechanism 109 before the door latch 10 is unlatched by a door handle or the like.

Obviously, many modifications and variations of the present invention in light of the above teachings may be made. It is, therefore, to be understood that, within the scope of the appended claims, the invention may be practiced otherwise than as specifically described.

We claim:

1. In a vehicle door latch having a fork bolt that is movable between an unlatched position and a latched position, the fork bolt having a latch shoulder that is engaged by a detent to hold the fork bolt in the latched position; and a movable transfer lever that is adapted for operation by inside and outside operators and that is operatively associated with the detent to disengage the detent from the latch shoulder of the fork bolt, characterized in that;

the vehicle door latch includes:

a cinching mechanism for moving the fork bolt to the latched position responsive to movement of the fork bolt away from the unlatched position by a predetermined distance comprising;

a position lever drivingly connected to the fork bolt for moving the fork bolt to the latched position;

a drive pin connected to a drive member for driving the position lever, and a shift mechanism for uncoupling the drive member from the position lever responsive to an unlatching operation of the vehicle door latch.

2. The vehicle door latch as defined in claim 1 wherein the drive pin is a cam follower that moves in a path determined by a cam that is part of the shift mechanism.

3. The vehicle door latch as defined in claim 2 wherein the shift mechanism moves the drive pin and the cam out of the path of travel of the position lever responsive to the unlatching operation of the vehicle door latch.

4. The vehicle door latch as defined in claim 3 wherein the drive member is driven by a reversible motor.

5. In a vehicle door latch having a rotatable fork bolt that is movable between an unlatched position and a primary latched position via an intermediate secondary latched position, the fork bolt having first and second latch shoulders that are engaged by a detent to hold the fork bolt in the secondary and primary latched positions, respectively; an intermittent member that is positioned by the detent and operatively connected to the detent for disengaging the detent from the first and second latch shoulders of the fork bolt; a movable transfer lever that is operated by inside and outside operating levers and that is operatively connected to the intermittent lever for moving the intermittent member to disengage the detent from the first and second latch shoulders of the fork bolt, characterized in that the vehicle door latch includes, a cinching mechanism for moving the fork bolt from the secondary latched position to the primary latched position responsive to movement of the fork bolt from the unlatched position to the intermediate secondary latched position, the cinching mechanism comprising:

a rotatable position lever drivingly connected to the fork bolt for movement between an unlatched position and a primary latched position via an intermediate secondary latched position corresponding to the respective unlatched position, primary latched position and intermediate secondary latched position of the rotatable fork bolt, a drive member engageable with an arm of the position lever for rotating the position lever from the intermediate secondary latch position to the primary latch position responsive to the movement of the fork bolt to the intermediate secondary latch position, a shift mechanism for moving the drive member out of the path of travel of the arm of the position lever responsive to an unlatching operation of the vehicle door latch by one of the inside and outside operating levers, the shift mechanism including a cam plate, a slide plate that supports the cam plate, a bell crank that shifts the slide plate laterally with respect to the position lever, and a transfer link that is operatively connected to the latching mechanism of the vehicle door latch, and the drive member being a cam follower having a path of movement that is determined by a cam that is part of the shift mechanism.

6. In a vehicle door latch having a fork bolt that is movable between an unlatched position and a primary latched position via an intermediate secondary latched position, the fork bolt having first and second latch shoulders that are engaged by a detent to hold the fork bolt in the secondary and primary latched positions, respectively; an intermittent member that is positioned by the detent and operatively connected to the detent for disengaging the detent from the first and second latch shoulders of the fork bolt; a movable transfer lever that is operated by inside and outside operating levers and that is operatively connected to the intermittent lever in an unlocked position for moving the intermittent member to disengage the detent from the first and second latch shoulders of the fork bolt, characterized in that the vehicle door latch includes, a cinching mechanism for moving the fork bolt from the secondary latched position to the primary latched position responsive to movement of the fork bolt away from the unlatched position by a predetermined amount, the cinching mechanism comprising:

a rotatable position lever drivingly connected to the fork bolt for movement between an unlatched position and a primary latched position via an intermediate secondary latched position, corresponding to the respective unlatched position, primary latched position and intermediate secondary latched position of the fork bolt, a drive pin connected to a drive member, said pin engageable with an arm of the position lever for rotating the position lever to the primary latch position responsive to the movement of the fork bolt away from the unlatched position by the predetermined amount, a shift mechanism for decoupling the drive member from the position lever responsive to an unlatching operation of the vehicle door latch, the shift mechanism including a cam plate having a cam slot that engages the drive pin and determines the path of movement of the drive pin, a slide plate that supports the cam plate, a bell crank that shifts the slide plate laterally with respect to the position lever, and a transfer link that is operatively connected to the latching mechanism of the vehicle door latch whereby the shift mechanism shifts the drive pin out of the path of travel of the arm of the position lever responsive the unlatching operation of the vehicle door latch.

7. The vehicle door latch as defined in claim 6 wherein the drive pin is driven by a bi-directional motor and the drive pin is returned to a starting position responsive to movement of the fork bolt to the primary latched position.

* * * * *